United States Patent [19]

Fuller et al.

[11] Patent Number: 4,843,354

[45] Date of Patent: Jun. 27, 1989

[54] BROAD BAND MICROWAVE BIASING NETWORKS SUITABLE FOR BEING PROVIDED IN MONOLITHIC INTEGRATED CIRCUIT FORM

[75] Inventors: Ronald D. Fuller, Mesa; Richard M. Dougherty; Craig L. Fullerton, both of Scottsdale; Hugh R. Malone, Phoenix, all of Ariz.

[73] Assignee: Motorola, Inc., Schaumburg, Ill.

[21] Appl. No.: 273,647

[22] Filed: Nov. 18, 1988

Related U.S. Application Data

[63] Continuation of Ser. No. 138,165, Dec. 28, 1987, abandoned.

[51] Int. Cl.[4] ..... H01P 1/22; H01P 1/15

[52] U.S. Cl. ..... 333/81 A; 307/259; 333/104; 333/262

[58] Field of Search ..... 333/103, 104, 81 R, 333/81 A, 258, 262; 307/542, 568, 571, 259, 317 R, 320; 330/261, 296

[56] References Cited

U.S. PATENT DOCUMENTS

| | | | |
|---|---|---|---|
| 4,492,937 | 1/1985 | Theriault | 333/103 |
| 4,712,025 | 12/1987 | Weiss | 307/571 |
| 4,733,203 | 3/1988 | Ayasli | 333/103 X |
| 4,742,249 | 3/1988 | Alpaiwalla et al. | 307/259 X |

*Primary Examiner*—Paul Gensler

*Attorney, Agent, or Firm*—Maurice J. Jones

[57] ABSTRACT

Inductorless bias networks include a bias circuit having a bias return path which is coupled to and biases a variable impedance device in a relatively nonconductive state. Another bias circuit including a FET renders the variable impedance device relatively conductive in response to control signals so that one port is coupled to another port, for instance.

32 Claims, 2 Drawing Sheets

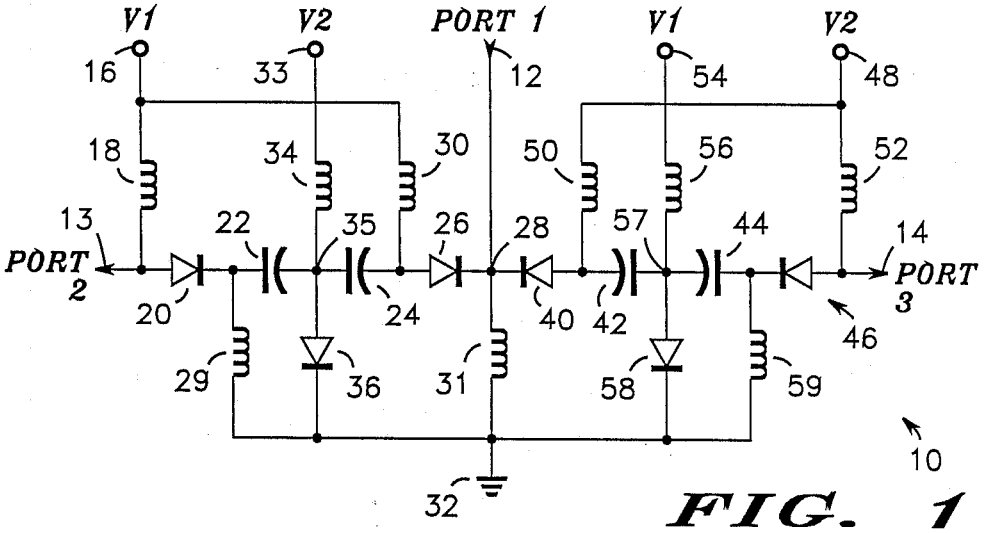
FIG. 1
–PRIOR ART–
FIG. 3
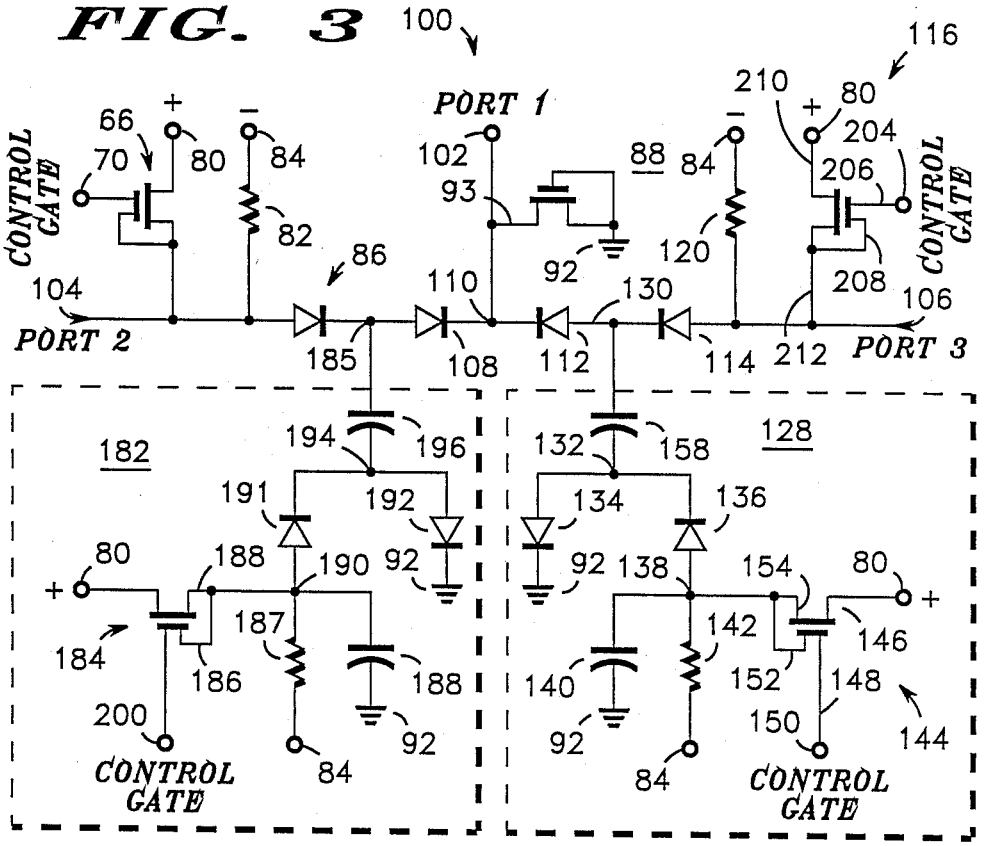

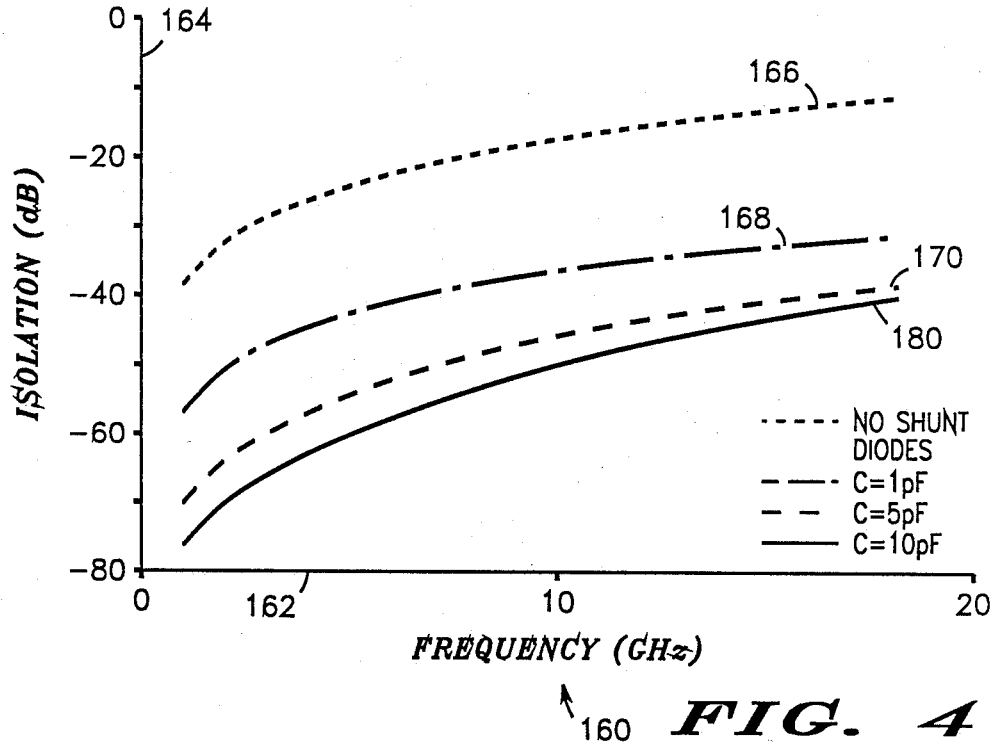
FIG. 4
FIG. 5
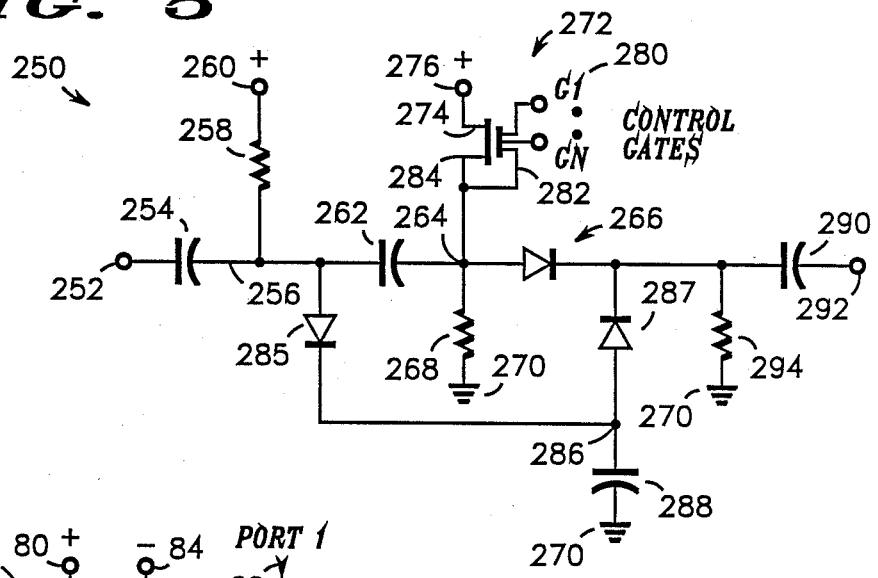
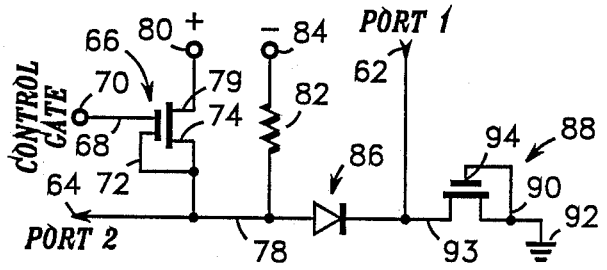
FIG. 2

BROAD BAND MICROWAVE BIASING NETWORKS SUITABLE FOR BEING PROVIDED IN MONOLITHIC INTEGRATED CIRCUIT FORM

BACKGROUND OF THE INVENTION

This application is a continuation of prior application Ser. No. 138,165, filed Dec. 28, 1987, abandoned.

This invention relates generally to active bias circuitry which provides broad bandwidths at microwave frequencies. More specifically, this invention relates to such circuitry which is suitable for being employed in Microwave Monolithic Integrated Circuits (MMICS).

Presently research and development resources are being directed toward providing circuitry suitable for use in gallium arsenide MMICS. Semiconductor circuits utilizing gallium arsenide are believed to be capable of taking up a much smaller amount of space and being operable at higher frequency levels than comparable semiconductor circuitry manufactured from silicon. To take advantage of the possible space saving and other benefits of gallium arsenide semiconductor, it is necessary to devise circuitry of different configurations than that previously employed in standard silicon and discrete applications.

More particularly, some presently available discrete radio frequency (RF) bias circuitry employs discrete inductors made from turns of wire to provide RF isolation. These coils are intended to provide an inductive impedance which increases with frequency to a high amount for isolating RF conductors from ground or from direct current (DC) conductors, while still providing the low impedance DC path for biasing active components. Such inductors perform satisfactorily in some applications up to frequencies of several Megahertz ($MH_z$) but such inductors are not suitable for being fabricated within integrated circuits where it is desired to keep the amount of space utilized to an absolute minimum. Moreover, such inductors tend to appear as capacitors or even as resonant circuits as the frequency applied to them exceeds several hundred Megahertz ($MH_z$). Furthermore, prior art bias circuitry sometimes requires the use of undesirably large or critical capacitors for passing RF signals and blocking DC bias voltages. These capacitors also sometimes require an undesirable amount of space, tend to become resonant at frequencies on the order of 2 Gigahertz ($GH_z$) and inductive at frequencies around 10 $GH_z$, for instance. A prior art embodiment of such bias circuitry including discrete inductors and capacitors is described in greater detail in a subsequent portion of this specification so that the problems can be more clearly understood.

SUMMARY OF THE INVENTION

Accordingly, one object of the invention is to provide active biasing circuitry for operation at microwave frequencies and over a wide bandwidth of approximately 500 $MH_z$ to 18 $GH_z$ which does not require the use of passive discrete inductors.

A further object is to provide active bias circuitry which is suitable for being provided in monolithic integrated circuit form and particularly for gallium arsenide MMIC applications.

An additional object of this invention is to provide active biasing networks for switching circuitry which provides a high degree of isolation when the switch is nonconductive.

A still further object of the invention is to provide active biasing circuitry for point-to-point connecting and shunting circuit elements utilizing active devices in which the circuit elements can be combined to provide various switch configurations such as single pole, single throw or single pole, double throw structures.

Another object is to provide bias circuitry responsive to control signals to provide bias signals of different magnitudes for controlling the amount of attenuation provided by an active attenuator.

Various other objects, advantages and features of the present invention will become readily apparent from the ensuing detailed description.

In accordance with one implementation, a port-to-port connecting element includes a diode connected in a RF signal path between the two ports. One bias circuit provides a reverse bias signal which tends to render the diode nonconductive. Another bias circuit includes a field effect transistor (FET) which is selectively rendered conductive to provide a forward bias signal to the diode which then connects the ports together. A further conductive component provides a DC return path for the diode.

A shunting switch element for selectively grounding unwanted RF signals includes two series connected diodes with a node therebetween that is coupled to a signal path to be shunted. One of the diodes has an electrode which is also connected to ground. A first bias circuit is coupled to the diodes to render them normally nonconductive. A second bias circuit includes a FET connected in parallel with the first bias circuit. The FET is selectively rendered conductive to provide forward bias to the diodes for rendering them conductive so that the grounded diode can provide a low impedance path to ground for the undesired signals.

The active biasing circuits can also include multi-gate FETS for providing biasing currents of predetermined controlled magnitudes to selectively vary the attenuation provided by a diode attenuator, for instance.

BRIEF DESCRIPTION OF THE DRAWINGS

FIG. 1 is a schematic diagram of a prior art single pole, double throw switch utilizing bias circuitry including discrete inductors and discrete capacitors;

FIG. 2 is a schematic diagram of a single pole, single throw switch element having an active bias circuit;

FIG. 3 is a schematic diagram of a single pole, double throw switch utilizing switch elements similar to that of FIG. 2 and additional shunt switching elements;

FIG. 4 is a family of curves showing various amounts of isolation with respect to frequency provided by changing the values of a capacitor included in one of the shunting elements of the circuitry of FIG. 3; and FIG. 5 is a schematic diagram of a variable attenuator circuit biased by a multi-gate FET.

A more complete understanding of the present invention may be derived by reference to the detailed description and the claims when considered along with the accompanying drawings.

PRIOR ART DESCRIPTION

FIG. 1 is a schematic diagram of a prior art single pole, double throw switch 10 which is suitable for connecting a first port 12 to either a second port 13 or a third port 14. For example, circuit 10 can be utilized to connect a transceiver antenna coupled to port 12 to either the input of a receiver connected to port 13 or to the output of a transmitter connected to port 14.

Switch 10 includes a control terminal 16 which is coupled through discrete inductor 18 to the anode of diode 20. The cathode of diode 20 is coupled through discrete capacitor 22, capacitor 24 and diode 26 to node 28. Inductor 29 provides a DC path from the cathode of diode 20 to ground or reference terminal 32. Control terminal 16 is further coupled through inductor 30 to the anode of diode 26. Inductor 31, which is connected between node 28 and ground conductor 32, provides a DC bias return path for diode 26. Series diodes 20 and 26 are rendered conductive in response to a positive control signal ($V_1$) at terminal 16 so that RF signals at terminal 12 are conducted to terminal 13.

Control terminal 33 is coupled through inductor 34 to node 35 between capacitors 22 and 24 and to the anode of shunt diode 36. The cathode of diode 36 is connected to ground conductor 32. Diode 36 is rendered nonconductive by a negative going control signal ($V_2$) applied to terminal 33.

The drive for control terminals 16 and 33 is arranged such that if $V_2$ is negative then $V_1$ is positive and vice versa. Thus, series diodes 20 and 26 are rendered nonconductive while shunt diode 36 is rendered conductive so that diode 36 tends to ground any RF signals leaking through diodes 20 or 26 when diodes 20 or 26 are nonconductive. Moreover, shunt diode 36 is rendered nonconductive when series diodes 20 and 26 are conductive.

Similarly, port 12 can be coupled through diode 40, capacitors 42 and 44 and diode 46 to port 14. Control terminal 48 is connected through inductor 50 to the anode of diode 40 and through inductor 52 to the anode of diode 46. Control terminal 54 is connected through inductor 56 to node 57 between series capacitors 42 and 44 and through shunt diode 58 to ground conductor 32. Inductor 59 is connected between the cathode of diode 46 and ground conductor 32.

Shunt diode 58 is rendered conductive by a positive voltage $V_1$ when diodes 40 and 46 are rendered nonconductive by negative going voltage $V_2$. Thus, diode 58 tends to shunt to ground any RF signal undesirably leaking through diodes 40 and 46. As mentioned, diodes 26 and 20 will be simultaneously rendered conductive in response to the positive going control signal $V_1$ which occurs when port 12 is connected to port 13.

Alternatively, when $V_2$ becomes positive and $V_1$ simultaneously becomes negative, then diodes 40 and 46 are rendered conductive to connect port 12 to port 14. Also, diodes 26 and 20 will be rendered nonconductive to isolate terminal 12 from terminal 13. Moreover, diode 36 will be rendered conductive to shunt any RF current leaking through diodes 20 and 26 to ground.

All of the inductors in circuit 10 of FIG. 1 are intended to be a high impedance through the band of operating frequencies so that the RF signals are not undesirably conducted to ground or into the circuitry providing control signals $V_1$ and $V_2$. Unfortunately, these inductors undesirably tend to decrease the operating bandwidth of circuit 10 at frequencies above a few hundred Megahertz ($MH_z$) because they tend to become capacitive or resonant at such frequencies. Also undesirably large inductors are needed to provide high isolating impedances at lower frequencies. Such large inductors are difficult or impossible to achieve on integrated circuits such as those utilized for MMICS.

Moreover, the capacitors of circuit 10 are required to have large critical values to provide low impedances at low frequencies. Thus, these capacitors tend to undesirably limit the lower cutoff frequency and hence the bandwidth of switch 10. Also, these capacitors tend to become resonant or inductive at frequencies in the $GH_z$ region. Accordingly, although switch 10 may be useful in discrete form at some frequencies, it is not suitable for being provided in an integrated circuit form or for use at frequencies above a few hundred $MH_z$ having wide bandwidths because of the bandwidth limitations created by the discrete inductors and capacitors thereof.

DETAILED DESCRIPTION OF THE PREFERRED EMBODIMENTS

FIG. 2 is a schematic diagram of single pole, single throw switch 60 for selectively connecting a first port 62 to a second port 64. Switch 60 includes a bias circuit having gallium arsenide, metal silicon field effect transistor (MESFET) 66 having a first gate 68 connected to control terminal 70 and second gate 72 connected to source 74 and to RF signal path conductor 78 which is connected to port 64. Drain 79 is connected to positive power supply conductor 80. Resistor 82 is connected between negative power supply terminal 84 and conductor 78. Gallium arsenide PIN diode 86 has an anode connected to conductor 78 and a cathode connected to port 62. Another gallium arsenide MESFET 88 has source 90 connected to ground or reference potential conductor 92 and drain 93 connected to port 62. Gate 94 of MESFET 88 is connected to source 90.

MESFETS 66 and 88 are normally conductive but can be depleted by negative gate bias to render them nonconductive. Since gate 94 of MESFET 88 is connected to source 90, MESFET 88 is normally conductive and provides a constant resistance on the order of 500 ohms which is high compared to the typically 50 ohm driving source connected to port 62. The connection of gate 72 to source 74 arranges MESFET 66 such that when rendered conductive MESFET 66 provides a predetermined amount of current, $I_{DSS}$ between drain 79 and source 74 thereof. Gate 70 is biased negative with respect to source 74 in a known manner so that no current flows through MESFET 66 unless control gate 70 is driven positive by a control signal. A negative voltage applied to terminal 84 is conducted through high value bias resistor 82 to the anode of diode 86 so that diode 86 is nonconductive when MESFET 66 is nonconductive.

When a positive control voltage is applied to control terminal 70, then MESFET 66 is rendered conductive and applies a forward bias signal to render diode 86 conductive. MESFET 88 provides a DC bias return for diode 86. Diode 86 provides a conductive path between port 62 and port 64 in response to a positive control signal at control gate 70. As a result, switch 60 can be turned on and off by respectively applying positive and negative control signals to control terminal 70.

Since circuit 60 does not include the inductors or critical capacitors of the prior art circuit of FIG. 1, switch 60 is operable at microwave frequencies exceeding a few $MH_z$ while providing a wide bandwidth on the order of approximately of 18 $GH_z$. Circuitry 60 is suitable for being implemented in MMIC form utilizing gallium arsenide MESFETS 68, 88 and a PIN diode 86. Alternatively, silicon devices could conceivably be employed in circuit 60 for other applications.

FIG. 3 includes a schematic diagram of single pole, double throw switch 100 which is suitable for selectively connecting first port 102 to either port 104 or to port 106. Some of the circuitry connected between port 102 and 104 is substantially similar to that previously described with respect to single pole, single throw switch 60 of FIG. 2 and hence utilizes the same reference numbers except for additional diode 108 which is connected between the cathode of diode 86 and drain 93 of MESFET 88 through node 110.

Circuit 100 further includes series diodes 112 and 114 which are connected between node 110 and port 106. Dual gate MESFET 116 is connected between positive voltage supply terminal 80 and port 106. Turn off resistor 120 is connected between negative power supply terminal 84 and the anode of diode 114.

When it is desired that port 102 be isolated from port 106 and connected to port 104, MESFET 116 is rendered nonconductive so that diodes 114 and 112 are nonconductive in response to the negative potential supplied by resistor 120. MESFET 66 is rendered conductive so that diodes 86 and 108 are conductive. Under these conditions, it is still possible that some of the signal being transferred from port 102 to port 104 might undesirably leak through diode 112 or that signals applied to port 106 might undesirably leak through diodes 114 and 112 to node 110. Hence, circuit 100 includes shunt circuitry 128 having capacitor 158 which is connected between conductor 130 and node 132. Diode 134 is connected between node 132 and ground conductor 92 and diode 136 is connected between node 132 and node 138. RF decoupling capacitor 140 is connected between node 138 and ground conductor 92 and turn off resistor 142 is connected between node 138 and the negative supply potential conductor 84. Dual gate FET 144 has drain electrode 146 connected to positive power supply conductor 80, a first gate control electrode 148 connected to terminal 150 and a second gate electrode 152 connected to source 154.

A positive control signal is applied to terminal 150 simultaneously with the positive control signal applied to control terminal 70 so that MESFET 144 is rendered conductive thereby providing a positive potential and drive current to node 138 which forward biases diodes 136 and 134. Hence, diode 134 provides a low impedance path to ground from terminal 132 for any undesired RF signal leaking onto conductor 130 through back biased diodes 112 or 114. These signals are coupled to node 132 by capacitor 158. Thus, circuitry 128 provides added isolation between port 106 and terminal 110. When MESFET 144 is conductive, capacitor 158 conducts the undesired RF signals to be grounded but blocks the direct current bias levels on conductor 130.

FIG. 4 illustrates a graph 160 having an abscissa axis 162 indicating frequency $GH_z$ and an ordinate axis 164 indicating isolation in dB. Curve 166 indicates the amount of isolation provided by reverse biased diodes 112 and 114 without shunt circuit 128. Curve 168 shows the increased amount of isolation provided by the addition of circuit 128 where capacitor 158 has a value of 1 picofarad. Curve 170 shows the further increased amount of isolation provided by shunt circuit 128 where capacitor 158 has a value of 5 picofarads and curve 180 indicates the even more increased amount of isolation provided where capacitor 158 has the capacitance of 10 picofarads. Hence, graph 160 illustrates that even small non-critical values of capacitor 158 can provide a significant increase in the isolation. Moreover, bypass capacitor 140 has a small non-critical value.

A similar shunt circuit 182 is also illustrated in FIG. 3 as being connected between node 184 which is connected to the anode of diode 108 and the cathode of diode 86. Shunt circuit 182 likewise includes a dual gate MESFET 184 having gate 186 connected to source 188 and to node 190. The drain of MESFET 184 is connected to positive power supply conductor 80. Resistor 187 is connected between node 194 and negative power supply conductor 84 and capacitor 188 is connected between node 190 and ground conductor 92. Diodes 191 and 192 are connected between node 190 and ground conductor 92. Node 194 which is connected to the cathode of diode 191 and the anode of diode 192 is coupled through capacitor 196 to node 185.

Circuit 182 shunts to ground undesired RF signals leaking through reverse biased diodes 86 and 108 in a manner similar to that already explained for circuit 128. Diodes 191 and 192 are rendered conductive in response to MESFET 184 being rendered conductive by a positive control signal applied to control terminal 200 thereof. MESFET 184 is rendered conductive simultaneously with MESFET 116 being rendered conductive by a positive control signal being applied to control terminal 204. MESFET 116 which includes gates 206 and 208 conducts the positive power supply potential coupled to drain 210 thereof to source 212 which thereby selectively renders diodes 114 and 112 conductive to connect port 102 to port 106. The control signals for circuits 60 and 100 can be provided by prior art circuitry (not shown) which is known or obvious to those of ordinary skill in the art. This circuitry could be activated by the "push-to-talk" switch of a transceiver, for instance.

FIG. 5 is a schematic diagram of PIN diode attenuator 250. Input signals to be attentuated are applied to input terminal 252 and coupled through coupling capacitor 254 to conductor 256. Resistor 258 is connected between conductor 256 and positive supply conductor 260. Capacitor 262 couples conductor 256 to node 264 which is also connected to the anode of diode 266. Bias resistor 268 which provides reverse bias to diode 266 is coupled between node 264 and ground or reference conductor 270. Multi-gate field effect transistor 272 has drain electrode 274 coupled to positive supply conductor 276 and a plurality of gate electrodes generally indicated by reference number 280. One of these gate electrodes 282 is connected to drain 284 which is also connected to node 264.

Diode 285 includes an anode connected to conductor 256 and a cathode connected to node 286. Capacitor 288 is connected between node 286 and reference conductor 270. Diode 287 has an anode connected to node 286 and a cathode connected to the cathode of diode 266. Capacitor 290 is coupled between the cathodes of diodes 266, 287 and output terminal 292. Bias return resistor 294 has one terminal connected to the cathodes of diodes 266 and 287 and another terminal connected to ground conductor 270.

Attenuator 250 attenuates a RF signal, for instance, provided at input terminal 252 and provides an attenuated output signal at terminal 292. Multi-gate FET 272 supplies forward biasing signals of predetermined magnitudes to diode 266 through node 264 to selectively overcome the negative bias otherwise provided by resistor 268. Various gates of multi-gate FET 272 are turned on or off to supply currents of constant magnitude to diode 266. The magnitude of this current depends on which of gates 280 are forward biased. If the magnitude of the forward biasing signal supplied by FET 272 is increased through diode 266, the magnitudes of the DC currents decrease through diodes 285 and 287 since resistor 294 sinks a relatively constant DC current. The impedances of PIN diodes 266, 285 and 287 vary directly with the amount of current being conducted by each of them. Thus, the desired impedance level of circuit 250 can be provided by controlling the bias currents through these diodes by controlling which gates 280 of FET 272 are conductive. Accordingly, circuit 250 can develop the desired amount of attenuation. FET 272 can be digitally controlled, for instance, to provide a bias current of a desired magnitude while providing a high impedance to the RF signal path through attenuator 250. FET 272 can be designed on a MMIC chip to provide the tailored current profile. Resistor 294 provides the DC bias return for the diodes. The gate widths of multi-gate FET 272 can be adjusted in a known manner to provide desired current profiles required by PIN diodes 266, 285 and 287 so that they can develop the desired attenuation characteristic.

Broad band microwave biasing networks suitable for being provided in monolithic integrated circuit form have been described. These networks provide active biasing circuitry for operation at microwave frequencies and over a wide bandwidth of approximately 500 $MH_z$ to 18 $GH_z$. The disclosed circuitry does not require the use of passive discrete inductors, large capacitors or capacitors having critical values. The circuitry disclosed is particularly suitable for gallium arsenide MMIC applications. The shunt circuits 128 and 182 of FIG. 3 provide a high degree of isolation when operative as explained. Circuit 60 of FIG. 2 includes biasing circuitry for providing point-to-point connections. Circuit 60 and a shunt element such as circuit 182 of FIG. 3 can be combined to provide various switch configurations such as single pole, single throw or single pole, double throw structures. Attenuator 250 of FIG. 5 includes a bias circuit including multi-gate FET 272 which provides bias signals of different magnitudes for controlling the amount of attentuation provided by diodes 266, 285, and 287.

While the invention has been described in conjunction with specific embodiments thereof, it is evident that many alterations, modifications and variations will be apparent to those skilled in the art in light of the foregoing description. Accordingly, the invention is intended to embrace all such alterations, modifications and variations in the appended claims.

We claim:

1. A circuit for providing an impedance of a controlled magnitude between an input terminal and an output terminal, including in combination:

a first diode responsive to changes in bias signals to provide impedances of different magnitudes, said first diode having first and second electrodes coupled between the input terminal and the output terminal;

first bias means coupled to said first diode for selectively biasing said first diode in a relatively nonconductive state so that the input terminal is thereby isolated from the output terminal;

means for providing control signals; and second bias means including a field effect transistor having first electrode, second electrode and control electrode, said control electrode being coupled to said means for providing control signals to selectively render said field effect transistor conductive, said first electrode being coupled to said first diode for providing bias signals for selectively rendering said first diode relatively conductive in response to said controls signals so that the input terminal is selectively coupled to the output terminal in response to said control signals.

2. The circuit of claim 1 wherein said first bias means includes resistive means.

3. The circuit of claim 1 further including bias current return means coupled to said first diode.

4. The circuit of claim 3 further including:

reference conductor means; and said bias current return means includes a further field effect transistor coupled between said first diode and said reference conductor.

5. The circuit of claim 1 wherein said first diode is a PIN diode; and said field effect transistor is a MESFET so that the circuit is operable at microwave frequencies.

6. The circuit of claim 4 wherein said MESFET has a multiple gate structure.

7. The circuit of claim 1 being further adapted to selectively shunt signals occurring at a node, to a reference terminal, said circuit further including in combination:

coupling means for coupling the node to said first diode;

a second diode having first and second electrodes, said first electrode being coupled to the node and said second electrode being coupled to the reference terminal;

a third diode having a first electrode and a second electrode, said second electrode of said third diode being coupled to said node;

first power supply conductor means;

third bias means coupled between said first power supply conductor means and said first electrode of said third diode; and fourth bias means including a further field effect transistor adapted to selectively provide forward biasing drive signals to said first electrode of said third diode to render said third diode conductive, said third diode thereby rendering said second diode conductive so that the signals applied to said node are coupled to said reference terminal through said second diode.

8. The circuit of claim 7 wherein said coupling means includes a capacitive means.

9. The circuit of claim 7 being provided in integrated circuit form.

10. A switching circuit for selectively connecting signals between a first terminal and a second terminal, said switching circuit including in combination:

a first diode having first and second electrodes, said first electrode being coupled to the first terminal and said second electrode being coupled to the second terminal;

a second diode having a first electrode and a second electrode, said second electrode of said second diode being coupled to the first terminal;

first power supply conductor means;

first bias means coupled between said first power supply conductor means and said first electrode of said second diode for rendering said second diode nonconductive; and second bias means including a first field effect transistor adapted to selectively provide forward biasing drive signals to said first electrode of said second diode to render said second diode conductive, said second diode thereby rendering said first diode conductive so that the signals applied to the first terminal are coupled to the second terminal through said first diode.

11. The switching circuit of claim 10 further including capacitive means coupled to said first terminal.

12. The switching circuit of claim 10 further adapted for providing a controlled impedance in a path between a first port and a second port, the path being coupled to the first terminal, the switching circuit further including in combination:

a third diode included in the path between the first port and the second port, said third diode having first and second electrodes;

third bias means coupled to and biasing said third diode in a relatively nonconductive state so that the first port is isolated from the second port;

means for providing control signals;

fourth bias means coupled to said third diode for selectively rendering said third diode relatively conductive in response to said controls signals so that the first port is then selectively coupled to the second port in response to said control signals, said fourth bias means including a second field effect transistor having first electrode means, second electrode means and control electrode means, said control electrode means being coupled to said means for providing control signals such that said second field effect transistor is rendered conductive to forward bias said third diode; and bias current return means coupled to said third diode.

13. The switching circuit of claim 12 wherein said first and second field effect transistors include gallium arsenide material.

14. A variable attenuator circuit for providing a resistance of a controlled magnitude between an input terminal and an output terminal, including in combination:

variable resistance means responsive to changes in bias signals to provide resistances of different magnitudes, said variable resistance means having first and second terminals coupled between the input terminal and the output terminal;

means for providing control signals; and bias means including a field effect transistor having first electrode, second electrode and a plurality of control electrodes, said control electrodes being coupled to said means for providing control signals to selectively render said field effect transistor conductive, said field effect transistor thereby being responsive to said control signals to provide bias signals of different magnitudes, said first electrode being coupled to said variable resistance means for providing said bias signals thereto for selectively rendering said variable resistance means conductive in response to said controls signals so that the input terminal is selectively coupled to the output terminal in response to said control signals.

15. The variable attentuator circuit of claim 14 wherein said variable resistance means includes a first diode having a first electrode and a second electrode.

16. The variable attentuator circuit of claim 15 further including:

reference conductor means; and bias current return means coupled between said first diode and said reference conductor means.

17. The variable attentuator circuit of claim 14 wherein said variable resistance means includes a first diode having a first electrode and a second electrode, and the variable attenuator circuit further including:

reference conductor means;

a second diode coupled between said first electrode of said first diode and said reference conductor means;

a third diode coupled between said second electrode of said first diode and said reference conductor means; and said diodes responding to said bias signals of different magnitudes to provide resistances of different magnitudes between the input terminal and the output terminal.

18. The variable attenuator circuit of claim 14 further including:

additional bias means coupled to said variable resistance means for selectively biasing said variable resistance means in a relatively nonconductive state so that the input terminal is thereby isolated from the output terminal.

19. A circuit for providing an impedance of a controlled magnitude between an input terminal and an output terminal, including in combination:

a first diode responsive to changes in bias signals to provide impedances of different magnitudes, said first diode having first and second electrodes coupled between the input terminal and the output terminal;

means for providing control signals; and bias means including a field effect transistor having first electrode, second electrode and control electrode, said control electrode being coupled to said means for providing control signals to selectively render said field effect transistor conductive, said first electrode being coupled to said first diode for providing bias signals for selectively rendering said first diode relatively conductive in response to said controls signals so that the input terminal is selectively coupled to the output terminal in response to said control signals.

20. The circuit of claim 19 including further bias means coupled to said first diode for selectively biasing said first diode in a relatively nonconductive state so that the input terminal is thereby selectively isolated from the output terminal.

21. The circuit of claim 20 wherein said further bias means includes resistive means.

22. The circuit of claim 19 further including bias current return means coupled to said first diode.

23. The circuit of claim 22 further including:

reference conductor means; and said bias current return means includes a further field effect transistor coupled between said first diode and said reference conductor.

24. The circuit of claim 19 wherein said first diode is a PIN diode; and said field effect transistor is a MESFET so that the circuit is operable at microwave frequencies.

25. The circuit of claim 24 wherein said MESFET has a multiple gate structure.

26. The circuit of claim 19 being further adapted to selectively shunt signals occurring at a node, to a reference terminal, said circuit further including in combination:

coupling means for coupling the node to said first diode;

a second diode having first and second electrodes, said first electrode being coupled to the node and said second electrode being coupled to the reference terminal;

a third diode having a first electrode and a second electrode, said second electrode of said third diode being coupled to said node; and second bias means including a further field effect transistor adapted to selectively provide forward biasing drive signals to said first electrode of said third diode to render said third diode conductive, said third diode thereby rendering said second diode conductive so that the signals applied to said node are coupled to the reference terminal through said second diode.

27. The circuit of claim 26 wherein said coupling means includes a capacitive means.

28. The circuit of claim 26 being provided in integrated circuit form.

29. A variable attenuator circuit for providing a resistance of a controlled magnitude between an input terminal and an output terminal, including in combination:

a first diode responsive to changes in bias signals to provide resistances of different magnitudes, said first diode having first and second terminals coupled between the input terminal and the output terminal;

first bias means coupled to said first diode for isolated selectively biasing said first diode in a relatively nonconductive state so that the input terminal is thereby isolated from the output terminal;

means for providing control signals; and second bias means including a field effect transistor having first electrode, second electrode and control electrode, said control electrode being coupled to said means for providing control signals to selectively render said field effect transistor conductive, said first electrode being coupled to said first diode for providing bias signals thereto for selectively rendering said first diode relatively conductive in response to said control signals so that the input terminal is selectively coupled to the output terminal in response to said control signals.

30. The variable attenuator circuit of claim 29 further including:

reference conductor means; and bias current return means coupled between said first diode and said reference conductor means.

31. The variable attenuator circuit of claim 29 wherein said field effect transistor has a plurality of gates so that said field effect transistor can respond to said control signals

32. The variable attenuator circuit of claim 31 wherein further first diode has a first electrode and a second electrode, and the variable attenuator circuit further including:

reference conductor means;

second diode coupled between said first electrode of said first diode and said reference conductor means;

third diode coupled between said second electrode of said first diode and said reference conductor means; and said diodes responding to said bias signals of different magnitudes to provide resistances of different magnitudes between the input terminal and the output terminal.

* * * * *